US009525219B2

(12) United States Patent
Köllmann et al.

(10) Patent No.: US 9,525,219 B2
(45) Date of Patent: Dec. 20, 2016

(54) SPRING-LOADED CLAMPING CONNECTION AND CONDUCTOR TERMINAL

(71) Applicant: WAGO Verwaltungsgesellschaft mbH, Minden (DE)

(72) Inventors: Hans-Josef Köllmann, Minden (DE); Wolfgang Gerberding, Hess. Oldendorf (DE)

(73) Assignee: WAGO Verwaltungsgesellschaft mbH, Minden (DE)

( * ) Notice: Subject to any disclaimer, the term of this patent is extended or adjusted under 35 U.S.C. 154(b) by 0 days.

(21) Appl. No.: 14/767,624

(22) PCT Filed: Feb. 12, 2014

(86) PCT No.: PCT/EP2014/052722
§ 371 (c)(1),
(2) Date: Aug. 13, 2015

(87) PCT Pub. No.: WO2014/124964
PCT Pub. Date: Aug. 21, 2014

(65) Prior Publication Data

US 2015/0380838 A1 Dec. 31, 2015

(30) Foreign Application Priority Data

Feb. 13, 2013 (DE) ..... 10 2013 101 410

(51) Int. Cl.
*H01R 4/48* (2006.01)

(52) U.S. Cl.
CPC ..... *H01R 4/4845* (2013.01); *H01R 4/4836* (2013.01); *H01R 4/489* (2013.01)

(58) Field of Classification Search
CPC ..... H01R 4/48; H01R 4/4845; H01R 4/4836; H01R 4/4827; H01R 13/193
(Continued)

(56) References Cited

U.S. PATENT DOCUMENTS 6,851,967 B2 * 2/2005 Miyoshi ..... H01R 4/4836 439/441
7,255,592 B1 * 8/2007 Tseng ..... H01R 4/22 439/439
(Continued)

FOREIGN PATENT DOCUMENTS

DE 195 39 931 3/1997
DE 600 00 150 12/2002
(Continued)

OTHER PUBLICATIONS

International Search Report for corresponding International application No. PCT/EP2014/052722 mailed May 12, 2014.
(Continued)

*Primary Examiner* — Xuong Chung Trans
(74) *Attorney, Agent, or Firm* — Renner, Otto, Boisselle & Sklar, LLP

(57) ABSTRACT

A spring-loaded clamping connection (1) for clamping electrical conductors, having a clamping spring (2) and having a bus bar (6) is described. The clamping spring (2) has a contact limb (3), a spring arc (4) adjoining said contact limb (3), and a clamping limb (5) adjoining the spring arc (4). The clamping limb (5) has a clamping edge (12) for forming a clamping point with the adjacent bus bar (6) for a conductor to be clamped. The spring-loaded clamping connection (1) also has a frame element (7), which is formed as a part separate from the clamping spring (2) and the bus bar (6) and which has a base portion (10), a curved portion (9) adjoining the base portion (10), and a retaining portion (8) adjoining said curved portion (9) and distanced from the base portion (10). The contact limb (3) of the clamping spring (2) is secured to the retaining portion (8). The retaining portion (8) extends in the projection of the extension direction of the contact limb (3). The curved portion (9) limits, behind the clamping point in the insertion direction (L) of a conductor
(Continued)

Figure 1:
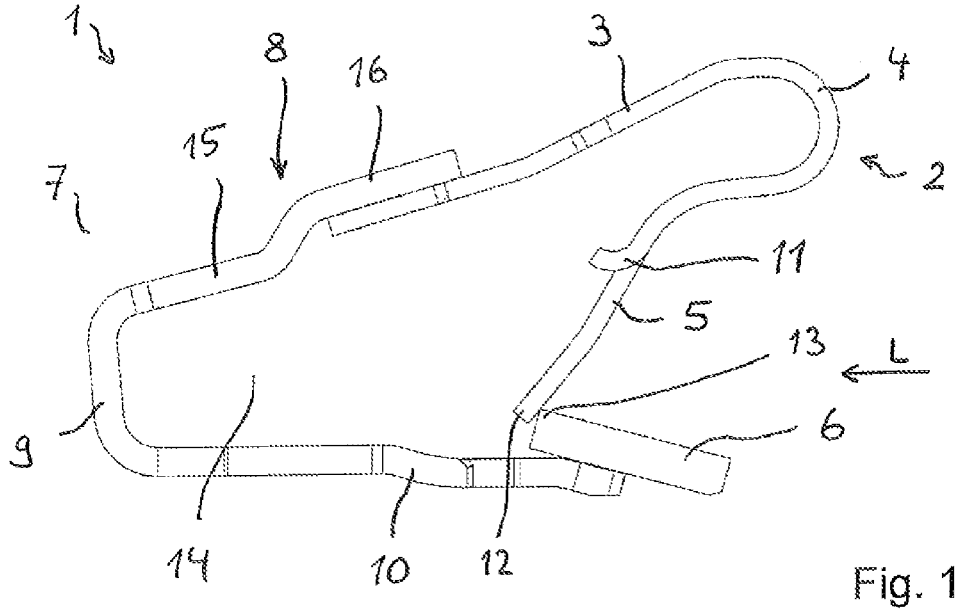

to be clamped, a conductor-accommodating space (14) for accommodating a free end of the electrical conductor. The base portion (10) extends from the curved portion (9) toward the free end of the base portion (10) counter to the insertion direction (L) of an electrical conductor to be clamped.

10 Claims, 3 Drawing Sheets

(58) Field of Classification Search
USPC ..... 439/441, 835
See application file for complete search history.

(56) References Cited

U.S. PATENT DOCUMENTS

| | | | | |
|---|---|---|---|---|
| 8,262,422 | B1 * | 9/2012 | Chiang | H01R 4/4836 439/441 |
| 2004/0161962 | A1 | 8/2004 | Kikuchi | |

FOREIGN PATENT DOCUMENTS

| | | |
|---|---|---|
| DE | 20 2006 015363 | 2/2008 |
| DE | 10 2010 024809 | 12/2011 |
| EP | 0 037 758 | 10/1981 |

OTHER PUBLICATIONS

International Preliminary Report on Patentability for corresponding International application No. PCT/EP2014/052722 dated Aug. 27, 2015.

* cited by examiner

SPRING-LOADED CLAMPING CONNECTION AND CONDUCTOR TERMINAL

This application is a national phase of International Application No. PCT/EP2014/052722 filed Feb. 12, 2014.

The invention relates to a spring-loaded clamping connection for clamping electrical conductors, having a clamping spring and a bus bar, wherein the clamping spring has a contact limb, a spring arc adjoining the contact limb, and a clamping limb adjoining the spring arc, and the clamping limb has a clamping edge for forming a clamping point with the adjacent bus bar for an electrical conductor to be clamped. The spring-loaded clamping connection also has a frame element, which is formed as a part separate from the clamping spring and the bus bar and which has a base portion, a curved portion adjoining the base portion, and a retaining portion distanced from the base portion. The contact limb of the clamping spring is secured to the retaining portion.

The invention also relates to a conductor terminal having an insulating material housing and a spring-loaded clamping connection of this type in the insulating material housing.

DE 10 2010 024 809 A1 discloses a terminal having a spring clamping unit that has a clamping spring and a bus bar. Separate clips can then be attached to the bus bar, which engage the bus bar from below and at the opposite end secure the contact limb to the clamping spring. The bus bar extends in the conductor insertion direction and is folded over at the end of the insulating material housing in order to create an accommodating pocket for the free end of an electrical conductor to be inserted.

U.S. Pat. No. 5,454,730 describes a terminal with clamping spring bent in a U-shape, which is bent behind the clamping point in the direction of the bus bar as considered in the conductor insertion direction and engages around said bus bar. The bus bar is bent in front of the clamping point, upwardly in the direction of the spring arc of the clamping spring and has a free end folded over in the conductor insertion direction, on which free end the spring arc rests via a portion of the contact limb adjoining said spring arc. A self-supporting construction is thus created.

Proceeding from this basis, the object of the present invention is to create an improved self-supporting spring-loaded clamping connection.

The object is achieved by the spring-loaded clamping connection having the features of claim 1. Advantageous embodiments are described in the dependent claims.

In the case of a generic spring-loaded clamping connection with frame element formed as a separate part it is proposed that the retaining portion extends in the projection of the extension direction of the contact limb, the curved portion delimits, behind the clamping point in the insertion direction of a conductor to be clamped, a conductor-accommodating space for accommodating a free end of the electrical conductor, and the base portion extends from the curved portion to the free end of the base portion counter to the insertion direction of a conductor to be clamped.

In contrast to a conventional transverse clip, extending transversely to the extension direction of a bus bar, for securing a clamping spring via the contact limb thereof to the bus bar, the frame element extends in the projection of the contact limb. This means that the separate frame part behind the clamping point forms a conductor-accommodating space. For this purpose the base portion extends toward the curved portion in the conductor insertion direction. The curved portion is then bent upwardly away from the bus bar plane, and the adjoining retaining portion extends in the primary extension direction of the contact limb, such that the contact limb is lengthened by the retaining portion and the contact limb is secured here to the retaining portion.

Such a U-shaped frame is not formed here simply in one part from the bus bar. In accordance with the present invention the frame is manufactured by a part separate from the clamping rail and the bus bar, i.e. not manufactured integrally with the bus bar and/or clamping spring. This has the advantage that the optimal material for technical and economical reasons and the optimal structure can be selected for each functional element. The bus bar is thus to be produced from material that is a very good electrical conductor, in particular copper material, in order to ensure a good current transmission at low transmission resistances. Copper material is very costly and relatively soft. By contrast, the clamping spring is to be produced from sheet spring material, which is less electrically conductive than sheet copper and is resilient. By contrast, material that is as rigid as possible and not resilient is necessary for the frame element. There is no fundamental demand on the electrical conductivity of the frame element. It should, however, be as economical as possible, since the frame element makes a significant contribution to the material requirement of the spring-loaded clamping connection. By way of example, the frame element can be formed from an economical, simple sheet steel.

Although the complexity of assembly and the production outlay are greater due to the plurality of parts, considerable advantages are still offered with regard to the material costs and in particular with regard to the fact that the frame element can be made very rigid due to optimal material selection.

The frame element can consist of a thicker material than the clamping spring and is not dependent on the clamping spring thickness. Lower demands are placed on the strength in the region of the frame element than in the region of the clamping spring, such that a more economical structure can be used there. Since the flexural rigidity is not dependent linearly on the material thickness, the separate frame element offers degrees of freedom in implementation.

With the frame element a conductor-accommodating space is formed in the projection of the bus bar in the conductor insertion direction, such that the frame element contributes not only to the retention and securing of the contact limb of the clamping spring, but also to the guidance of the free end of an electrical conductor clamped at a clamping point in the event of insertion into the spring-loaded clamping connection.

In order to secure the contact limb of the clamping spring on the retaining portion, the retaining portion of the separate frame element has, in a preferred embodiment, a protruding centering lug, which enters a centering opening in the contact limb of the clamping spring.

The centering lug can be formed in a particularly simple and economical manner, for example as an embossed stamp from the sheet material of the frame element. For this purpose, when the sheet material is shaped in order to produce the frame element, sheet material is pressed out from the plane of the frame element on the underside using an embossing die in order to form there a centering lug that for example is circular.

Such an embossing can be performed during the production process for example, when a parallel misalignment relative to the part of the retaining portion adjoining the curved portion is created at the free end of the retaining portion, such that the free end of the retaining portion engages over the contact portion and here the contact portion lies approximately in the plane of the plane defined by part of the retaining portion adjoining the curved portion.

Alternatively or additionally to the centering lug of the retaining portion, it is conceivable that the contact limb of the clamping spring has a protruding centering lug, which enters a centering opening in the retaining portion of the frame element and secures the clamping spring to the retaining portion. However, the variant of the introduction of a centering lug made of the sheet material of the frame element lends itself on account of the different materials, wherein the clamping spring is formed from a thin spring steel material and the frame element is generally formed from a thicker, slightly deformable sheet steel.

Alternatively or additionally to the centering lugs, the contact limb of the clamping spring may be welded, soldered, riveted, wedged, pressed, glued or screwed to the retaining portion of the frame element. Other possibilities of fastening the contact limb to the retaining portion of the frame element are conceivable, wherein the different materials of frame element and clamping spring generally have to be taken into consideration The contact limb here can be arranged on the side of the retaining portion pointing in the direction of the bus bar, such that the contact limb is arranged internally and the frame element is arranged externally. A self-supporting construction is promoted as a result. However, it is also conceivable that the contact limb lies on the retaining portion on the side of the retaining portion opposite the bus bar. It is also possible that the free end of the retaining portion is splayed in order to accommodate the contact limb between two forks of the retaining portion.

In a preferred embodiment the bus bar lies on the base portion of the frame element. The frame element thus forms not only a mount for the contact limb of the clamping spring, but also for the bus bar, such that the clamping force of the clamping spring acts on the bus bar via an inserted electrical conductor and is absorbed by the base portion arranged below the bus bar.

Due to the use of the base portion of the frame element as a support for the bus bar, the base portion can also contribute, additionally to the bus bar, to the current transmission and to cooling. Although no fundamental requirement is placed on the electrical conductivity of the frame element, the electrical conductivity of the frame element allows the use of a bus bar with smaller cross section. A bus bar usually formed from electrolytic copper has a much higher conductivity than simple steel and in particular than spring steel. When forming the frame element from steel an electrical conductivity of approximately 10 to 20% of the bus bar also leads to a sufficient current transmission and temperature reduction due to the proportionally large cross section and the relatively large surface, such that the bus bar can be designed in a smaller cross section. The supporting of the bus bar on the base portion of the frame element also has the advantage of a higher short circuit reliability, since the frame element provides a much greater mass of conductive material compared to the bus bar.

It is particularly advantageous when the bus bar indentations receive and guide an electrical conductor to the clamping point. These indentations are preferably arranged in front of the clamping point, as considered in the conductor insertion direction, and are used for improved guidance of an electrical conductor to the clamping point and from there into the conductor insertion space surrounded by the frame element.

The bus bar in a preferred embodiment does not lie simply only on the base portion, but is secured to the base portion. A unit of the frame element and bus bar formed from different materials would thereby be created.

In order to open a clamping point formed by the clamping spring and the bus bar, the clamping limb preferably has at least one actuation tab arranged on the edge region of the clamping limb. This actuation tab can then be acted on with an actuation force using an actuation tool having an actuation lever installed in a pivotably mounted manner in an insulating material housing or having a linearly displaceable actuation pusher. The clamping limb is thus moved away from the bus bar in order to open the clamping point.

The object is also achieved by a conductor terminal having an insulating material housing, in which an above-described spring-loaded clamping connection is installed.

Figure 2:
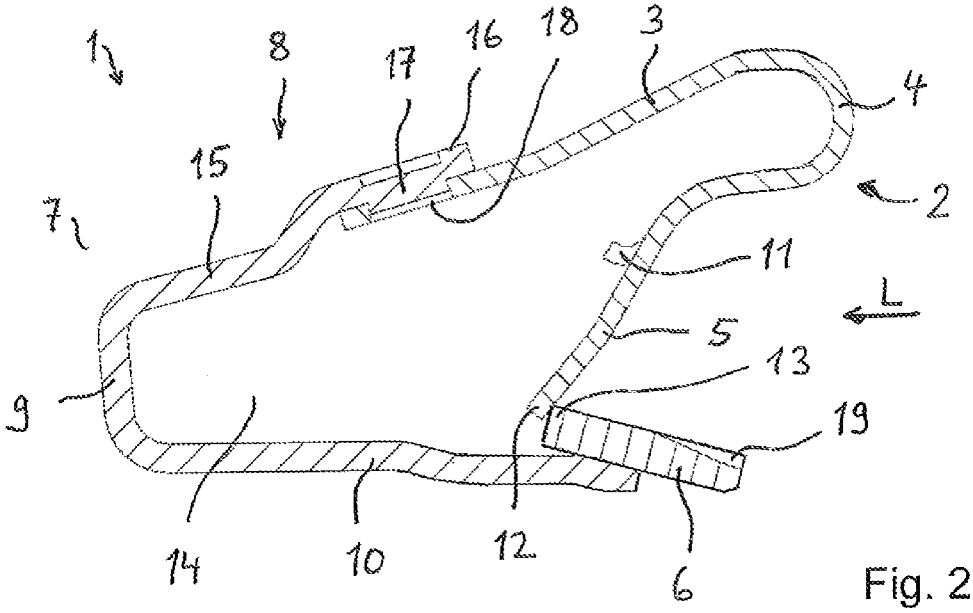
Figure 3:
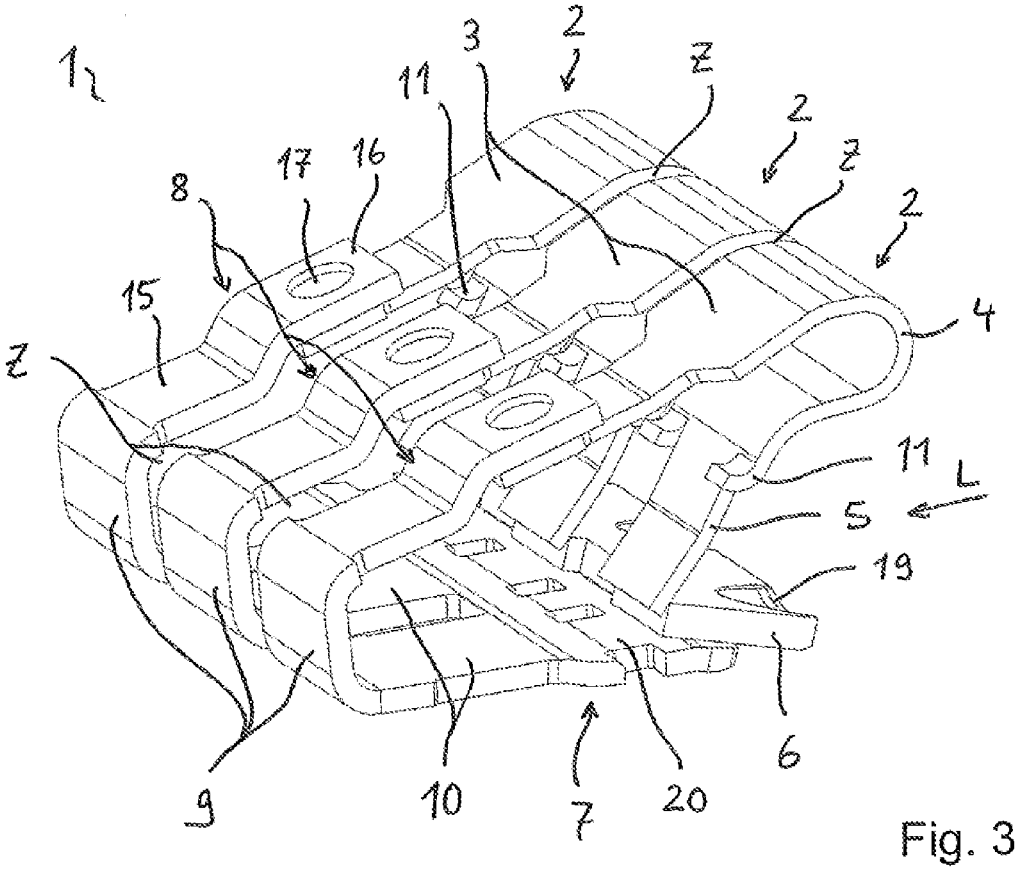
Figure 4:
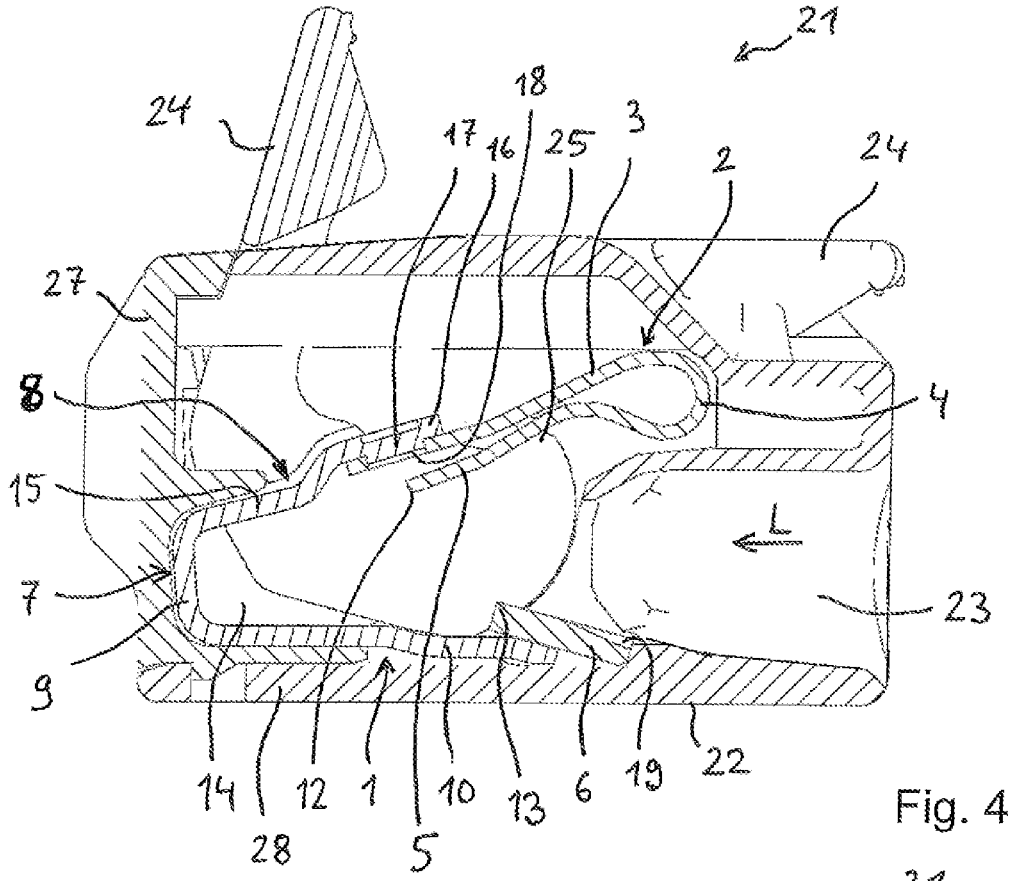
Figure 5:
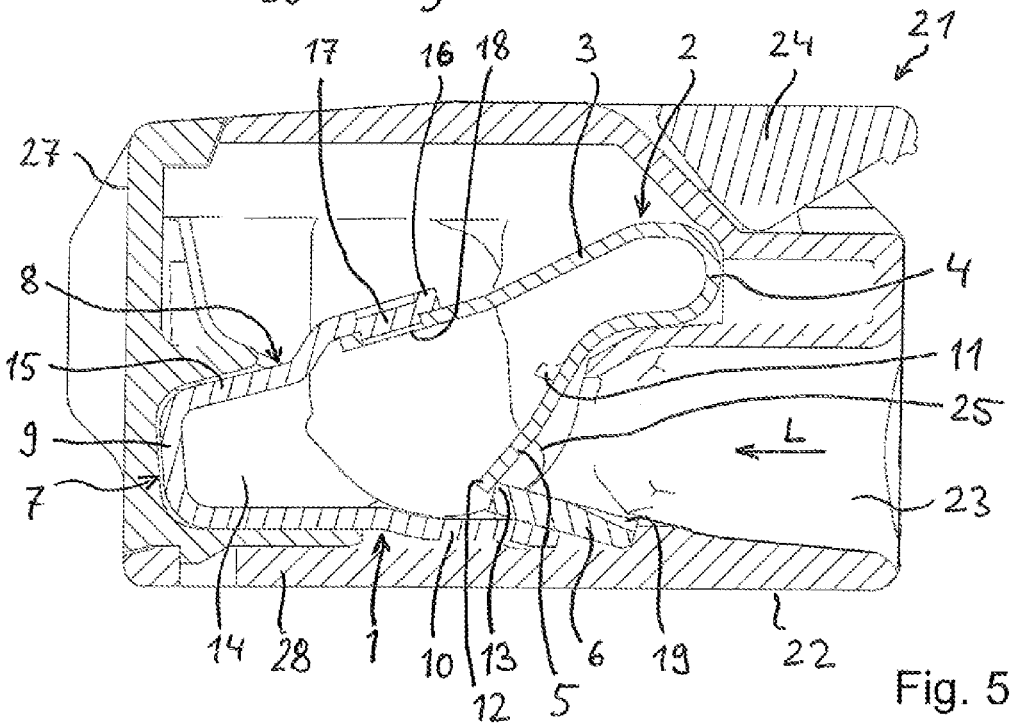

The invention will be explained in greater detail hereinafter on the basis of the accompanying drawings, in which:

FIG. 1—shows a side view of a spring-loaded clamping connection;

FIG. 2—shows a side sectional view of the spring-loaded clamping connection from FIG. 1;

FIG. 3—shows a perspective view of the spring-loaded clamping connection from FIGS. 1 and 2;

FIG. 4—shows a side sectional view of a conductor terminal having a spring-loaded clamping connection from FIGS. 1 to 3 installed in an insulating material housing, with opened actuation lever;

FIG. 5—shows a side sectional view of a conductor terminal having a spring-loaded clamping connection from FIGS. 1 to 3 installed in an insulating material housing, with closed actuation lever.

FIG. 1 shows a side view of a spring-loaded clamping connection 1, which is formed from three parts. The spring-loaded clamping connection 1 has a clamping spring 2 made of a sheet spring steel. spring steel is a steel with increased strength, i.e. a significantly increased elastic limit compared with structural steel, for example. The ratio of yield point to tensile strength in the case of spring steels usually lies in the region of more than 85%. The clamping springs are produced for example form chromium-nickel spring steel, i.e. from a chromium- and nickel-containing alloy. The clamping spring 2 is U-shaped in principle and has a contact limb 3, an adjoining spring arc 4, and a clamping limb 5 adjoining the spring arc 4.

The clamping limb 5 is pushed away from the contact limb 3 in the direction of a bus bar 6 by the force of the clamping spring 2, in particular applied by the spring arc 4. The bus bar 6 is the second part of the spring-loaded clamping connection 1. The bus bar is usually formed from electrolytic copper material and is preferably tin-plated. Good electrical current conductivity with low transmission resistances is thus ensured.

The spring-loaded clamping connection 1 also has a frame element 7 formed as a part separate from the clamping spring 2 and the bus bar 6. This frame element is formed for example from a sheet steel. This sheet material should be as rigid as possible and, in contrast to the clamping spring 2, should have minimal resilience. The frame element 7 is preferably produced from what is known as a basic steel, which is alloyed to a low extent and is only partially heat-treated. However, it is also conceivable that the frame element 7 is created from a tool steel or the like or in some circumstances also from fiber composite material or the like. In any case, it should be as rigid as possible, such that the frame element 7 is not expanded, not even when an electrical conductor is clamped and a resultant spring force pressure is produced.

The frame element 7 may preferably consist of a thicker material than the clamping spring 2 and is not dependent on the thickness of the clamping spring 2. Higher strengths compared with the use of spring steel are therefore possible without greater outlay. Since the bending strength is not dependent linearly on the material thickness, the separate frame element 7 offers degrees of freedom in implementation irrespective of the design of the clamping spring 2 in view of the spring properties and irrespective of the design of the bus bar 6 in view of the current transmission characteristics.

The frame element 7 has a retaining portion 8, which extends in the projection of the extension direction of the contact limb 3 and to which the contact limb 3 of the clamping spring 2 is secured. The retaining portion 8 is adjoined by a curved portion 9, which for example is folded over, for example by two bends or kinks, downwardly in the direction of the plane of the bus bar 6. The curved portion 9 is adjoined by a base portion 10. The base portion 10, via its free end, engages the bus bar 6 from below, the bus bar resting in this way on the base portion 10. Here, the bus bar 6 can also be secured to the base portion 10 in that the bus bar 6 is fitted into the free end of the base portion 10, welded, soldered, riveted or screwed thereto.

Furthermore, an actuation tab 11 may protrude from the clamping limb 5 in a lateral region of the clamping limb 5 of the clamping spring 2. This actuation tab 11 can then be acted on by means of an actuation tool, such as a screwdriver or preferably by means of an actuation element movable pivotably or linearly in an insulating material housing, in order to move the clamping limb 5 in the direction of the contact limb 3 counter to the clamping force of the clamping spring 2. A clamping point for clamping an electrical conductor, which clamping point is formed between a clamping edge 12 at the free end of the clamping limb 5 and a contact edge 13 on the bus bar 6, is thus opened, such that a clamped electrical conductor can be removed from the spring-loaded clamping connection 1.

The insertion direction of the electrical conductor to be clamped is defined not only by a conductor insertion opening in an insulating material housing of a conductor terminal surrounding the spring-loaded clamping connection 1, but also by the clamping point with the adjoining clamping limb 5 and bus bar inclined at an angle to one another. The conductor insertion opening thus corresponds approximately to the width direction of the bus bar 6 visible in the side view or the extension direction of the clamping limb 5 in the direction of the clamping edge 12 of the clamping spring 2 when the clamping point is opened, when the clamping limb 5 borders the contact limb 3.

It is clear that the base portion 10 extends from its free end to the curved portion 9, approximately in the conductor insertion direction L. Here, the exact angular position of conductor insertion direction L and extension direction of the base portion 10 is irrelevant. It is crucial that the base portion 10 is not substantially transverse to the conductor insertion direction.

The frame element 7 is then bent upwards in the curved portion 9 from the plane of the base portion into the plane of the contact limb 3, transversely to the conductor insertion direction L, such that the curved portion 9 is substantially transverse to the conductor insertion direction L and a conductor-accommodating space 14 arranged behind the clamping point formed by the clamping edges 12 of the clamping spring 2 and the contact edge 13 of the bus bar 6 is delimited at the end by the curved portion 9, as considered in the conductor insertion direction L. The curved portion 9 is then adjoined by the retaining portion 8, which extends opposite the conductor insertion direction L toward the free end thereof. It is clear that the retaining portion 8 and base portion 10 extend from the curved portion 9 toward their respective free end opposite the conductor insertion direction in order to thus form, together with the curved portion 9, a frame element 7 that is U-shaped in section.

The free end region 16 of the retaining part 8 adjoins the first part 15 of the retaining portion 8 adjoining the curved portion 9. This free end region 16 is offset by a bend from the plane of the first part 15 of the retaining portion 8. The free end of the contact limb 3 lies on the inner side of the free end 16 of the retaining portion 8 facing toward the base portion 10. Due to the offset of the planes, the contact limb 3 then lies substantially in the same plane as the first part 15 of the retaining portion 8 adjoining the curved portion 9.

FIG. 2 shows a side sectional view of the spring-loaded clamping connection 1 from FIG. 1. It is clear beyond the design already described in FIG. 1 that the free end 16 of the retaining portion 8 has an embossed centering lug 17. This centering lug 17 for example forms a circular nub, which protrudes in the direction of the base portion 10 from the inner wall of the free end 16 of the retaining portion 8 facing toward the base portion 10. The centering lug 17 here enters a centering opening 18 in the free end of the contact limb 3 of the clamping spring 2, said centering opening corresponding to the centering lug 17. The contact limb 3 is thus secured to the retaining portion 8.

It can also be seen that the bus bar, as considered in the conductor insertion direction L, has an indentation 19 in front of the wall in the region on the upper side in order to receive and guide an electrical conductor to the clamping point formed by the clamping edge 12 and contact edge 13.

FIG. 3 shows a perspective view of the spring-loaded clamping connection 1 from FIGS. 1 and 2. Here, it is clear that three clamping springs 2 are arranged adjacently in a row and are distanced from one another by an intermediate space Z. A common bus bar 6 can be seen for the three clamping springs 2, which bus bar extends in the direction of successive arrangement of the clamping springs 2 and transversely to the conductor insertion direction L.

The frame element 7 is also formed in one part from a sheet metal part for all three clamping springs 2. Here, a support plate 20 is provided, on which the bus bar 6 is supported and which likewise extends transversely to the conductor insertion direction L and in the direction of successive arrangement of the clamping springs 2. A base portion 10 starts from this common support plate 20 for each clamping spring 2 and extends in the conductor insertion direction L. The base portions 10 are then adjoined in each case by a curved portion 9 in the manner described above, which curved portion transitions into a retaining portion 8 at a distance from the respective base portion 10.

Due to the provision of a separate base portion 10, curved portion 9 and retaining portion 8 for each clamping spring 2, these portions are distanced from one another by an intermediate space Z. The intermediate space Z can then be used to receive one of a number of parts of an actuation element.

Otherwise, however, it is also conceivable that only one common base portion 10, curved portion 9 and retaining portion 8 is provided for the plurality of clamping springs 2.

FIG. 4 shows a side sectional view through a conductor terminal 21 with an insulating material housing 22, in which the above-described spring-loaded clamping connection 1 is installed. It is clear that the insulating material housing 22 on the front side has a spring-loaded clamping connection 1 and a conductor insertion opening 23, which in the primary extension direction defines the insertion direction L of an electrical conductor to be clamped.

It can be seen that an actuation lever 24 for each spring-loaded clamping connection 1 is mounted in each case pivotably in the insulating material housing 22. Here, the portion of the actuation lever 24 entering the insulating material housing 22 is preferably arranged laterally beside the spring-loaded clamping connection in order to thus act on the actuation tab 11 on the clamping limb 5 of the associated clamping spring 2 via an actuation contour 25. In the illustrated open position of the actuation lever 24 the clamping edge 12 of the clamping limb 5 is moved upwardly in the direction of the contact limb 3, away from the bus bar 6 in order to thus open the clamping point formed by the clamping edge 12 and the contact edge 13. An electrical conductor can thus be easily introduced into the conductor terminal 21 or a clamped electrical conductor can thus be easily removed.

It is clear that the frame element 7 extending in the conductor insertion direction L delimits, behind the clamping point, a conductor-accommodating space 14 upwardly, downwardly and to the rear. A secure guidance also of the stripped end of an inserted electrical conductor is thus ensured. At the same time, as a result of the frame element 7, the clamping spring 2 is held in a stable position with respect to the bus bar 6, such that the spring-loaded clamping connection 1 forms a self-supporting structure, in which minimal forces act on the insulating material housing. Here, the actuation lever 24 is advantageously supported via its pivot bearing 24*a* on the base portion 10 of the frame element 7.

It can also be seen that the insulating material housing 22 is formed in two parts and has a terminal housing part 28 and a cover part 27 latched thereto. The spring-loaded clamping connection 1 and the actuation lever 24 can thus be installed first in the terminal housing part 28, and the insulating material housing 22 can then be closed by latching the cover part 27 onto the terminal housing part 28.

FIG. 5 shows the conductor terminal 21 from FIG. 4 in the closed position. Here, the clamping point formed by the clamping edge 12 on the clamping limb 5 of the clamping spring 2 and by the contact edge 13 of the bus bar 6 is closed. In the illustrated position without clamped electrical conductor, the clamping edge 12 and the contact edge 13 border one another.

Here, the clamping limb 5 is pushed by the spring force of the clamping spring 2 in the direction of the bus bar 6. The actuation portion 25 of the actuation lever 24 here no longer acts on the actuation tab 11 of the clamping limb 5, such that the clamping limb 5 can now move in a manner not influenced by the actuation lever 24, utilizing the spring force of the clamping spring 2.

It is clear that the spring-loaded clamping connection 1 here is self-supporting. Here, the clamping spring 2 exerts a clamping force directed counter to the bus bar 6, which clamping force is transmitted by supporting the bus bar 6 on the base portion 10 of the frame element 7. The oppositely directed retaining force of the clamping spring 2 is transmitted from the contact limb 3 to the retaining portion 8. Due to the relatively rigid embodiment of the frame element 7, the oppositely directed forces are thus compensated for via the frame element 7, and considerable forces are prevented from acting on the insulating material housing 22.

The invention claimed is:

1. A spring-loaded clamping connection for clamping electrical conductors, comprising:

a bus bar;

a clamping spring having a contact limb, a spring arc adjoining said contact limb, and a clamping limb adjoining the spring arc, wherein the clamping limb includes a clamping edge for forming a clamping point with the adjacent bus bar for a conductor to be clamped; and a frame element formed as a part separate from the clamping spring and the bus bar, the frame element including a base portion, a curved portion adjoining the base portion, and a retaining portion adjoining said curved portion and distanced from the base portion, wherein the contact limb of the clamping spring is secured to the retaining portion, and the retaining portion extends in the projection of the extension direction of the contact limb and lengthens the contact limb, the curved portion limits, behind the clamping point in the insertion direction of a conductor to be clamped, a conductor-accommodating space for accommodating a free end of the electrical conductor, wherein the conductor-accommodation space is delimited upwardly by the retaining portion, downwardly by the base portion and to the rear by the curved portion of the frame element, and the base portion extends from the curved portion toward the free end of the base portion counter to the insertion direction of a conductor to be clamped.

2. The spring-loaded clamping connection as claimed in claim 1, wherein the contact limb of the clamping spring is secured to the retaining portion of the frame element by welding, soldering, riveting, wedging, pressing, gluing or screwing.

3. The spring-loaded clamping connection as claimed in claim 1, wherein the retaining portion of the frame element has a protruding centering lug, which enters a centering opening of the contact limb of the clamping spring and secures the clamping spring to the retaining portion.

4. The spring-loaded clamping connection as claimed in claim 3, wherein the centering lug is formed as an embossed stamp from the sheet metal material of the frame element.

5. The spring-loaded clamping connection as claimed in claim 1, wherein the contact limb of the clamping spring has a protruding centering lug, which enters a centering opening in the retaining portion of the frame element and secures the clamping spring to the retaining portion.

6. The spring-loaded clamping connection as claimed in claim 1, wherein the bus bar lies on the base portion.

7. The spring-loaded clamping connection as claimed in claim 1, wherein the bus bar has indentations for accommodating and guiding an electrical conductor to the clamping point.

8. A spring-loaded clamping connection as claimed in claim 1, wherein the bus bar is secured to the base portion.

9. The spring-loaded clamping connection as claimed in claim 1, wherein the clamping limb has at least one actuation tab arranged laterally on the edge region of the clamping limb.

10. A conductor terminal having an insulating material housing, comprising a spring-loaded clamping connection as claimed in claim 1 in the insulating material housing.

* * * * *